US005675852A

United States Patent [19]

Watkins

[11] Patent Number: 5,675,852

[45] **Date of Patent: *Oct. 14, 1997**

[54] INFANT BODY SUPPORT PAD

[76] Inventor: Charles Eugene Watkins, 3131 N. Druid Hills Rd., #10303, Decatur, Ga. 30033

[ * ] Notice: The term of this patent shall not extend beyond the expiration date of Pat. No. 5,305,483.

[21] Appl. No.: 513,948

[22] PCT Filed: Mar. 8, 1994

[86] PCT No.: PCT/US94/02599

§ 371 Date: Nov. 6, 1995

§ 102(e) Date: Nov. 6, 1995

[87] PCT Pub. No.: WO94/20001

PCT Pub. Date: Sep. 15, 1994

[51] Int. Cl.[6] ..... A47G 9/00

[52] U.S. Cl. ..... 5/638; 5/726

[58] Field of Search ..... 5/638, 726, 423, 5/714, 725, 636, 284, 910, 645, 724; 297/180.13, 180.11, 180.1; 128/202.18, 205.26, 716; 600/22

[56] References Cited

U.S. PATENT DOCUMENTS

| | | | |
|---|---|---|---|
| 1,142,876 | 6/1915 | Davis et al. . | |
| 2,025,659 | 12/1935 | Gilquin . | |
| 2,059,226 | 11/1936 | Gates . | |
| 2,085,296 | 6/1937 | Carey . | |
| 2,493,067 | 12/1950 | Goldsmith . | |
| 2,512,559 | 6/1950 | Williams . | |
| 3,089,153 | 5/1963 | Bosc . | |
| 3,266,064 | 8/1966 | Figman . | |
| 3,486,177 | 12/1969 | Marshack . | |
| 3,644,950 | 2/1972 | Lindsay, Jr. . | |
| 3,681,797 | 8/1972 | Messner . | |
| 4,206,524 | 6/1980 | Cook . | |
| 4,391,009 | 7/1983 | Schild et al. . | |
| 4,694,521 | 9/1987 | Tominaga . | |
| 4,825,488 | 5/1989 | Bedford . | |
| 4,867,230 | 9/1989 | Voss | 5/284 |
| 5,305,483 | 4/1994 | Watkins | 5/725 |
| 5,317,767 | 6/1994 | Hargest et al. | 5/423 |

FOREIGN PATENT DOCUMENTS

| | | | |
|---|---|---|---|
| 0491145 | 6/1992 | European Pat. Off. . | |
| 1391506 | 4/1975 | United Kingdom . | |
| 1574888 | 9/1980 | United Kingdom | 5/726 |

OTHER PUBLICATIONS

Raloff, J. "Do Some SIDS Victims Actually Suffocate?" pp. 403, 405, Jun. 29, 1991, Science News—The Weekly Newsmagazine of Science.

Gilbert–Barness et al., "Hazards of Mattresses, Beds and Bedding in Deaths of Infants," pp. 27–32, The American Journal of Forensic Medicine and Pathology, vol. 12, #1, 1991.

Dwyer et al., "Prospective Cohert Study of Prone Sleeping Position and Sudden Infant Death Syndrome," pp. 1244–1247, May 25, 1991, The Lancet, vol. 337.

Christine Gorman, "Beware of the Pillow," p. 48, Jul. 8, 1991, Time Magazine.

Kemp et al., "Sudden Death in Infants Sleeping on Polystyrene–Filled Cushions," pp. 1858–1864, Jun. 27, 1991, The New England Journal of Medicine.

*Primary Examiner*—Alexander Grosz

[57] ABSTRACT

The present invention solves a possible contributing cause of Sudden Infant Death Syndrome. A body support pad has a support portion and a pillow portion. The support portion is removably connected to the pillow portion. The pillow portion provides ventilation to the infant. The pillow portion has a thin outer sheet permeable to the passage of air. The pillow portion also keeps the head of the infant in healthy repose. The interior of the pillow is subdivided into an upper portion containing a porous foam material and a lower portion containing an air pocket. An air pump supplies air to the air pocket to thereby supply air to the nose and mouth of the infant.

20 Claims, 1 Drawing Sheet

INFANT BODY SUPPORT PAD

BACKGROUND OF THE INVENTION

The present invention pertains to a body support pad, and more particularly to a pillow for supplying a sufficient amount of air passage to and from an infant lying thereon.

A leading cause of deaths nationally among infants from two weeks to one year of age has become known as Sudden Infant Death Syndrome. Medical researchers nationally have spent the past decades trying and failing to unravel the cause of death for such a significant number of infants. The majority of the studies conducted found that infants which are usually found dead are particularly newly born, premature and twins. However, the cause of death to these infants is frustrating because numerous instances exist where a parent has placed a normal healthy infant on its stomach in a crib or bed to only come back a short time later to find the infant dead.

The numerous studies that have been conducted and reported have only resulted in medical personnel advising parents to not place their infants face down on a crib or bed because this position seems to increase the risk of Sudden Infant Death Syndrome. For decades, these doctors, nurses and care guidebooks have advised placing infants on their back or side in the crib or bed. However, parents have been opposed to placing the infants in this position because of an infant's preference for sleeping on its stomach and/or the infant's tendency to vomit. Further, parents seem to believe that the risk is not so great to make the infants unhappy and sleepless by placing them into another position.

Applicant believes that a contributing cause of death for these infants results from the infants rebreathing of carbon dioxide. This occurs from the fact that the infants are placed on their stomachs and may be too weak to be able to move from this lying position. Accordingly, the infants rebreath the carbon dioxide that is trapped in the loose sheets held against the infants' face.

The present invention addresses the above problem and provides a solution to this possible contributing cause of Sudden Infant Death Syndrome. As this application is being prepared, more research is expected on the above problems, but researchers and medical personnel have been unable to solve the mystery behind the sudden death of such a significant number of infants. Further, none of the references uncovered by Applicant's search recognizes or proposes solutions for the possible contributing causes of Sudden Infant Death Syndrome.

SUMMARY OF THE INVENTION

The present invention provides a means for solving a possible contributing cause of Sudden Infant Death Syndrome. Applicant solves this problem by providing an infant support pad that is both cost effective to manufacture and simple to use.

A body support pad has a body support portion and pillow portion, said body support portion comprising a covered foam padding support which is connected to said pillow portion, said pillow portion providing breathing aid means for supporting the head of an infant, and providing ventilation to the portion of the skin of said infant in contact with said pillow portion, said pillow portion comprising:

a thin pliable outer sheet portion having a lower surface and sidewall surfaces which are relatively impermeable and having an upper support surface which is relatively permeable to the passage of air;

said outer sheet portion enclosing an interior volume of sufficient length and width to fully underlie the head of said infant even during infant tossing and turning, said interior volume also being of sufficient overall thickness to support said head of said infant in a position of healthy repose;

said enclosed interior volume being further subdivided into upper and lower portions, one above the other, with said upper portion being formed of a porous foam material and said lower portion being a void defining an air pocket bounded on the bottom and sides by said lower surface and sidewall surfaces of said thin pliable outer wall portion, and on the top by said sheet of porous foam material;

air pump means for supplying steady breathing air flow to said air pocket, wherein:

said steady breathing air flow to said air pocket causes air to flow past said nose and mouth of said infant without any effort on the part of the infant.

An object of the present invention is to provide a pillow portion for supplying a sufficient amount of air flow near the infant's face and nose.

Another object of the present invention is to provide, a pillow breathing device that includes a low pressure pump that will allow for pumping air out of the air pocket to cause a suction through the perforations in the outer sheet and foam pad so that any carbon dioxide laden air will be drawn away from the infant's face.

These another objects and advantages will become apparent from the following description of a preferred embodiment of the invention taken together with the accompanying drawings.

DETAILED DESCRIPTION OF THE PREFERRED EMBODIMENT

Figure 1:
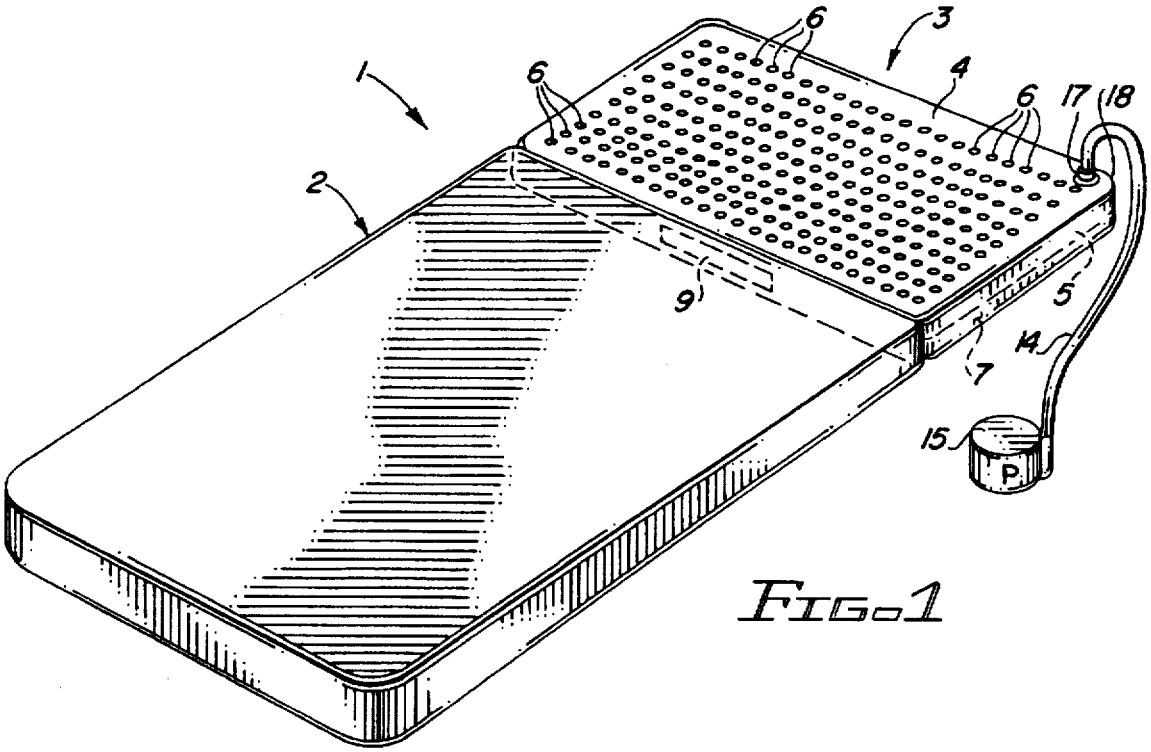
FIG. 1 is a perspective view of the body support pad of the present invention.
Figure 2:
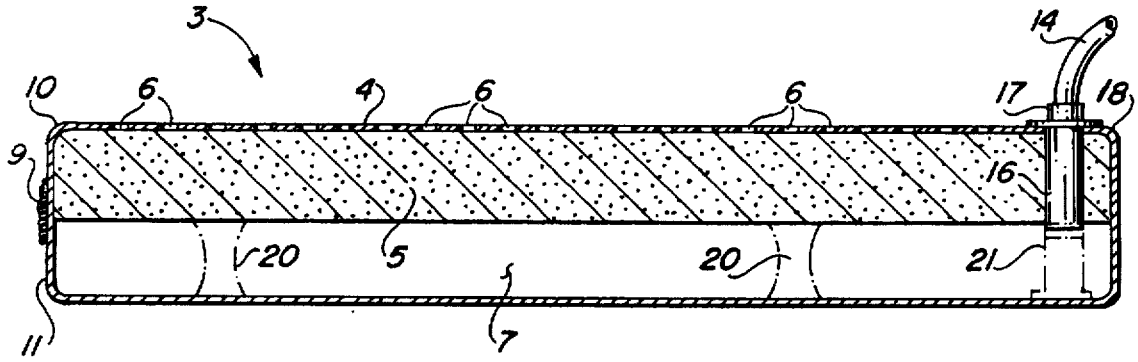
FIG. 2 is a sectional view showing the pillow portion of the body support pad of FIG. 1.

With reference to the figures, FIG. 1 and 2 show body support pad 1 for use as a body support pad for an infant lying thereon. The body support pad 1 is designed to not only support the infant lying thereon, but also supply air flow to the infant as well as remove any carbon dioxide or other expelled or objectionable gases from the area in close proximity to the infant's face and nose.

The body support pad 1 comprises a pad 2 for supporting the infant's body and a pillow 3 that not only provides support for the infant's head but includes air breathing means for supplying a sufficient amount of breathing air to the area near the infant's face and nose. The breathing air supplied to the infant is preferably normal fresh air but may be oxygen enriched air, water vapor enriched (humidified) air or an other type of medicine mixture.

Referring to pad 2 in detail, pad 2 is preferably constructed of a covered oblong shaped foam pad of sufficient length and width to support the infant's body lying thereon. The interior of the pad 2 is preferably comprised of a soft porous material enclosed by a thin cloth, plastic, rubber or an equivalent soft material. Although not necessary, it is desirable to form the body support pad 1 by having an end section of the pad 2 attached to an end section of the pillow 3 at 9. For example, it is contemplated that a strip of hook and loop type fastener, such as that sold under the. Trademark VELCRO, would be an ideal way to form a readily detachable connection between pad portion 2 and pillow portion 3. Of course, pad 2 could be formed of a shape other than oblong and be of a different length and width to conform to infants of different sizes and weights.

The structure of pillow 3 may be best understood with reference to FIG. 2. As illustrated in FIG. 2, the interior of pillow 3 comprises essentially two main portions, an upper portion 10 and a lower portion 11 that together form the pillow 3 of sufficient length and width to underlie the head of an infant.

The upper portion 10 of pillow 3 is preferably comprised of a porous foam material 5 that will allow purification as well as filtration of air passing therethrough. Upper portion 10 includes a covering or outer sheet 4 on the outer surface of the upper portion 10 as illustrated by FIG. 1. Outer sheet 4 is perforated and preferably includes a plurality of perforations 6 for allowing air passage to and from air pocket 7 through the porous material and outer sheet 4. The size and number of perforations 6 included on the outer sheet 4 may vary depending upon the size and weight of the infant intending to use the body support pad 1. Perforations 6 are of significantly greater diameter than the pores or openings in a normal sheet or blanket. The reason for these enlarged perforations is to assure that ventilation will not be clogged by vomit or sputum from the infant.

Pillow portion 3 includes an air hole 17 at an end of the pillow 3 opposite the pad 2 for allowing air passage to and from an exterior air source like air pump 15. Air hole 17 comprises a hollow cylindrical tube or feed pipe 16, that extends downward from an outer corner 18 of pillow 3 through the outer sheet 4 and the porous foam material 5, and opens into air pocket 7.

A low pressure air pump 15 is provided for supplying air flow to and from air pocket 7 through a conduit means 14. Conduit means 14 is connected at one end to air pump 15 and to air hole 17 at the other end. The air is pumped by air pump 15 through the conduit means 14 to fill the void defining the air pocket 7. Positive circulation of the air through the air pocket 7, and up through the porous material and outer sheet 4, is effective in removing any latent air from around the infant's face and nose.

As an alternative mode of operation, air pump 15 may be configured as a vacuum pump. In this mode, ambient air pressure forces air down through perforations 6, through the porous foam material 5, into air pocket 7, and out to pump 15. To prevent atmospheric pressure from collapsing air pocket 7 in this mode, it is desirable to extend feed pipe opening 21 well below the bottom of the porous foam pad and into air pocket 7. This feed pipe extension will serve to maintain the integrity and shape of air pocket 7.

In addition, it is contemplated that spacers 20 or the like be included in the air pocket 7 for preventing the collapse of air pocket 7. The spacers 20 may be used to prevent the air pocket 7 from collapsing during either mode of operation or from any liquid obstruction from the infant.

The present invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What I claim is:

1. A breathing aid which supports and provides ventilation to an infant, having a lower surface connected to interconnected sidewall surfaces, said breathing aid comprising:

an upper support surface which is relatively permeable to the passage of air and connected to the sidewall surfaces to thereby define an interior volume;

an air permeable cushioning member disposed within the interior volume adjacent to the upper support surface;

a lower void defined within the interior volume adjacent to said cushioning member to provide an air pocket;

an air pump supplying sufficient air flow to fill said air pocket and support the weight of an infant lying thereon;

an air conduit connected to said air pump; and a pliable feed pipe passing through an aligned aperture defined by said upper support surface and said air permeable cushioning member, wherein said pliable feed pipe transmits air from said air conduit to said lower void.

2. The breathing aid according to claim 1, wherein said upper support surface includes a plurality of perforations which permit passage of breathable air.

3. The breathing aid according to claim 1, further comprising:

an extended portion connected to and extending downwardly from said air conduit, passing into said lower void and contacting the lower surface, whereby said extended portion prevents collapse of said air pocket.

4. The breathing aid according to claim 1, further comprising:

a spacer, disposed within said air pocket and adjacent to said air permeable cushioning member and the lower surface, thereby preventing collapse of said air pocket.

5. The breathing aid according to claim 1, wherein said air pump removes air from said lower void through suction to thereby provide a steady breathable air flow to said infant as ambient air flows through said air permeable cushioning member to replace air removed from said lower void.

6. A breathing aid comprising:

a lower surface connected to interconnected sidewall surfaces;

an upper support surface which is relatively permeable to the passage of air and connected to said sidewall surfaces to thereby define an interior volume;

an air permeable cushioning member disposed within the interior volume adjacent to said upper support surface;

a lower void defined within the interior volume adjacent to said cushioning member to provide an air pocket;

an air pump supplying sufficient air to fill said lower void;

a pliable feed pipe passing through said upper support surface and said air permeable cushioning member, and having a first end opening into said lower void; and a flexible tube connecting said air pump and said pliable feed pipe;

wherein pressurized breathable air flows from said air pump, through said flexible tube, through said pliable feed pipe, into said lower void, through said air permeable cushioning member, and through said upper support surface, thereby providing ventilation to said infant.

7. The breathing aid according to claim 6, wherein said upper support surface includes a plurality of perforations which permit easy passage of breathable air.

8. The breathing aid according to claim 6, further comprising:

an extended portion connected to and extending downwardly from said pliable feed pipe, passing into said lower void and contacting said lower surface, whereby said extended portion prevents collapse of said air pocket.

9. The breathing aid according to claim 6, further comprising a spacer, disposed within said air pocket, and adjacent to said air permeable cushioning member and the lower surface thereby preventing collapse of said air pocket.

10. The breathing aid according to claim 6, wherein said air pump alternatively removes air from said lower void through suction to thereby provide a steady breathable air flow to said infant as ambient air flows through said air permeable cushioning member to replace air removed from said lower void.

11. A breathing aid which supports and provides ventilation to an infant, the breathing aid having a lower surface connected to interconnected sidewall surfaces, said breathing aid comprising:

an upper support surface which is relatively permeable to the passage of air and connected to the sidewall surfaces to thereby define an interior volume;

an air permeable cushioning member disposed within the interior volume adjacent to said upper support surface;

a lower void defined within the interior volume adjacent to said cushioning member to provide an air pocket; and a pliable feed pipe passing through an aligned aperture defined by said upper support surface and said air permeable cushioning member, and connecting said lower void and an area above said upper support surface.

12. The breathing aid according to claim 11, wherein said upper support surface includes a plurality of perforations which permit easy passage of breathable air.

13. The breathing aid according to claim 11, further comprising:

an air pump connected to said pliable feed pipe and supplying sufficient air flow to fill said air pocket and support the weight of an infant lying thereon, whereby a steady breathable air flow is provided to said infant.

14. The breathing aid according to claim 13, wherein said upper support surface includes a plurality of perforations which permit easy passage of breathable air.

15. The breathing aid according to claim 13, wherein said air pump removes air from said lower void through suction to thereby provide a steady breathable air flow to said infant as ambient air flows through the air permeable cushioning member to replace air removed from said lower void.

16. The breathing aid according to claim 11, further comprising a spacer, disposed within said air pocket, and adjacent to said air permeable cushioning member and the lower surface thereby preventing collapse of said air pocket.

17. The breathing aid according to claim 11, further comprising:

an air pump; and a flexible tube having a first end connected to said air pump and a second end connected to said pliable feed pipe;

wherein pressurized breathable air flows from said air pump through said flexible tube, through said pliable feed pipe, into said lower void, through said air permeable cushioning member, and through said upper support surface, to thereby provide ventilation to said infant.

18. The breathing aid according to claim 17, wherein said air pump alternatively removes air from said lower void through suction to thereby provide a steady breathable air flow to said infant as ambient air flows through said air permeable cushioning member to replace air removed from said lower void.

19. The breathing aid according to claim 18, wherein said upper support surface includes a plurality of perforations which permit easy passage of air.

20. The breathing aid according to claim 11, further comprising:

an air pump connected to said pliable feed pipe and supplying sufficient flow to fill said air pocket, whereby a steady breathable air flow is provided to said infant.

* * * * *